US005190291A

United States Patent [19]

Melvin

[11] Patent Number: 5,190,291

[45] Date of Patent: Mar. 2, 1993

[54] GOLF CLUB WHICH PROVIDES SENSORY INFORMATION DURING A SWING

[76] Inventor: John N. Melvin, 10545 Lennox La., Dallas, Tex. 75229

[21] Appl. No.: 855,196

[22] Filed: Mar. 20, 1992

[51] Int. Cl.[5] ..... A63B 69/36

[52] U.S. Cl. ..... 273/186.2; 273/80 B; 273/81.3

[58] Field of Search ..... 273/186 A, 183 D, 80 B, 273/193 R, 193 B, 194 R, 81 R, 81.3

[56] References Cited

U.S. PATENT DOCUMENTS

| | | | |
|---|---|---|---|
| 1,662,712 | 8/1927 | Mensing | 273/80 |
| 2,250,429 | 6/1933 | Vickery | 273/80 |
| 3,229,980 | 1/1966 | Silberman | 273/186 A |
| 3,317,211 | 5/1967 | Debski | 273/81 R X |
| 4,319,750 | 3/1982 | Roy | 273/80 B |
| 4,580,785 | 5/1986 | Toku | 273/186 A |
| 4,936,582 | 6/1990 | Bernstein | 273/80 B X |
| 4,982,963 | 1/1991 | Fazio et al. | 273/80 B X |
| 5,026,063 | 6/1991 | Rhodes | 273/80 B X |

*Primary Examiner*—George J. Marlo
*Attorney, Agent, or Firm*—Whitham & Marhoefer

[57] ABSTRACT

A golf club includes an extremely flexible shaft (22) which is cylindrical and has a high flex point relative to the head (24). Twisting of the flexible shaft (22) under the influence of an incorrect "twist" swing as well as flexing of the shaft (22) under the influence of a hitting motion rather than a swinging motion can easily be sensed by the golfer. The golf club also includes a flexible handle (26) connected to the end of the shaft (22) which provides a second flex point on the handle and allows sensing the incorrect application of hand effort during a golf swing. A shock absorber (36) located in the neck (34) of the club head (24) allows the shaft (22) to take a tremendous impact without breaking. Providing the shaft (22) with suitable connectors (38) allows the club to be broken down to a compact transportable form.

20 Claims, 2 Drawing Sheets

GOLF CLUB WHICH PROVIDES SENSORY INFORMATION DURING A SWING

BACKGROUND OF THE INVENTION

1. Field of the Invention

The present invention generally relates to golf clubs used for training golfers proper golf swing tempo and, more particularly, to golf clubs which have highly flexible shafts.

2. Description of the Prior Art

FIG. 1 shows a traditional golf club which includes a head 10, a shaft 12, and a grip 14. The head 10 can be a wood, including a steel wood or the like, an iron, or a putter. The shaft 12 projects down into the neck 16 of the head 10 and is secured by glue, pins, whipping, or other means. The grip 14 is secured to the top part of the shaft 12 by glue or the like and is generally tapered, and is often made from leather or rubber materials. The grip 14 is intended to provide the golfer with a firm hand hold on the shaft 12. Most golf club shafts 12 are relatively stiff and are made from hollow steel tubes or graphite rods. Many golfers have thought that a golf club with a stiffer shaft 12 can be hit more accurately on the belief that reduced flexing of the shaft 12 enhances the likelihood of the head 10 being in the correct position to strike a golf ball at the bottom of the downswing. In addition, most golf club shafts 12 are tapered from the top 18 towards the bottom 20, whereby flexing of the shaft 12 during a golf swing is accentuated towards the narrower diameter bottom 20. Many golfers have thought that moving the shaft 12 flex point closer to the golf ball, as is done with a tapered shaft, will provide greater control.

It has been well recognized by golf instructors that many of the problems experienced by golfers are related to an improper swing rather than the golf club design. As early as 1928, U.S. Pat. No. 1,662,712 issued to Carl Mensing on a golf club with an extremely limber or whippy shaft. Specifically, Mensing contemplated using rubber, rattan wood, or raw hide shafts on golf clubs. Golfers swinging the Mensing type golf clubs need to use a smooth, rhythmic swing in order to correctly strike the golf ball. If the golfer applies a jerking or quick hitting motion to a golf club with an extremely limber or whippy shaft, he or she will either slice the golf ball or miss it completely. When the Mensing type golf club is swung properly, the golf ball will travel the same distance or further as it would with a normal club because the club head will be moving at the same rate as the club head of a properly swung normal golf club.

The golf club shown in U.S. Pat. No. 1,662,712 to Mensing has a tapered shaft and, therefore, has a flex point below the median region of the club. It was later determined that a higher flex point on the shaft can be beneficial. Specifically, in U.S. Pat. No. 2,250,429 to Vickery a golf club with a reduced diameter medial region is shown. Vickery likened the golf club to a baseball pitcher's arm and stated that flexing at the medial region would be analogous to the pitcher's elbow. Vickery also contemplated reducing the diameter of the shaft towards the club head so that it would behave like a baseball pitcher's wrist. Vickery's club shaft designs have the drawback of requiring additional manufacturing steps in order to create the reduced regions. In addition, the reduced diameter regions of the Vickery club shaft are likely to encounter severe stresses during the golf swing and they may be more prone to failure.

Twisting of the golf club during the swing is a common problem among golfers. A "twist" swing occurs when a golfer twists his or her wrists severely during a golf swing. When the club shaft is twisted, the club head will strike the golf ball improperly and make it unlikely that the ball will fly straight to its target. U.S. Pat. No. 4,580,785 to Toku shows a golf club shaft which includes a metal leaf spring positioned inside the hollow, cylindrical shaft. The Toku golf club provides the golfer with sensor information in the form of vibrations from the metal leaf spring when a golfer executes an improper "twist" swing. Because the Toku golf club is cylindrical, it naturally flexes in its middle region. A particular drawback of the Toku golf club is that the shaft requires several components and would be difficult to manufacture.

The manner by which a golfer controls his or her hands can also lead to several problems in striking a golf ball. For example, applying severe hand effort at the top of the backswing will take the club head out of a good swing groove and will generally result in a poor shot. In addition, premature application of power with the right hand (for right handed golfers) immediately prior to impact will decelerate the club head and cause loss of distance and a shot that goes to the right. Likewise, "wristiness" with a putter can pull the putter head off line. None of the prior art training golf clubs provide any means for a golfer to sense improper hand action as well as tempo and twisting swing problems.

SUMMARY OF THE INVENTION

It is therefore an object of this invention to provide a golf club which provides sensory information to a golfer related to improper tempo, twisting, and improper hand effort.

It is another object of this invention to provide a golf club which includes two flex points, one high on the shaft and the other in the handle.

It is still another object of this invention to provide a golf club which can take a severe impact when it strikes the ground improperly.

According to the invention, a golf club includes a highly flexible shaft connected to a flexible handle and a golf club head. The highly flexible shaft is capable of severely flexing under the influence of a hitting as opposed to a swinging motion, and twists freely upon improper rotation of the hands during a golf swing. The flexible handle provides a second flex point at the position occupied by the thumb and index finger of the right hand which allows the golfer to sense improper hand activity. A shock absorber is positioned within the neck of the club head to reduce the impact of improper ground strikes on the shaft. Specialty clubs such as putters and sand wedges may have two or three piece shafts which allow compact storage of the club. Male-female connectors can be used for connecting the shaft segments together.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF A PREFERRED EMBODIMENT OF THE INVENTION

Figure 2:
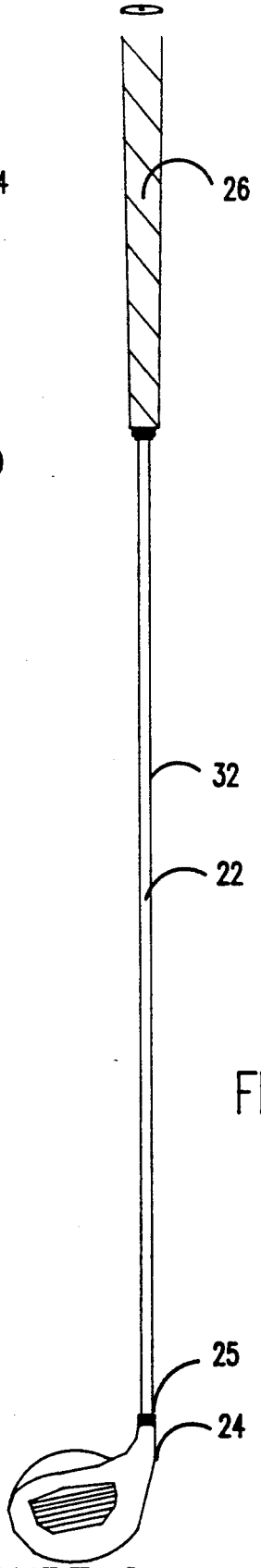
FIG. 2 is an isometric side view of the golf club according to the present invention.
Figure 6:
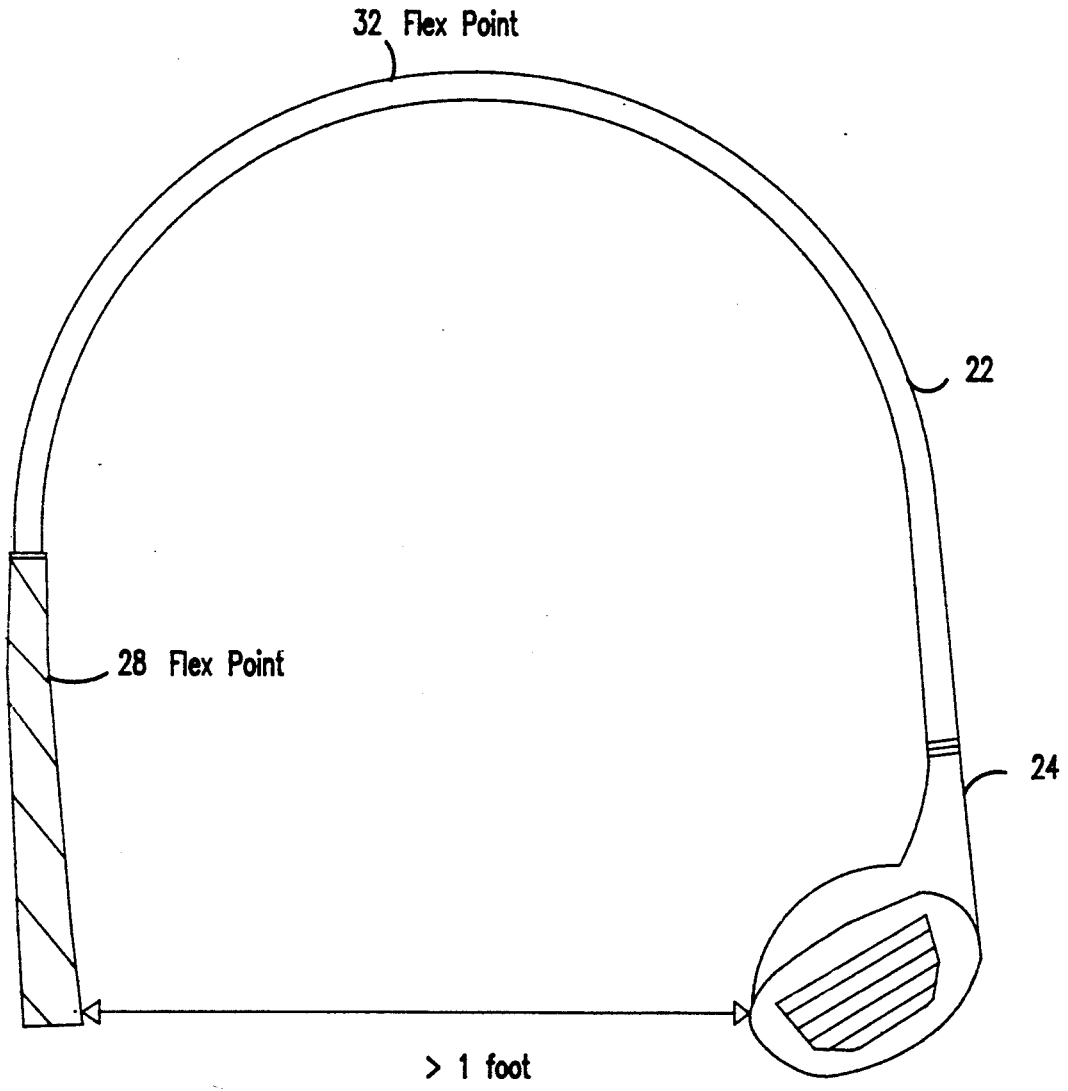
FIG. 6 is a side view of the golf club of FIG. 2 where the shaft has been bent to a point where the head is less than one foot from the handle.

Referring now to FIG. 2, there is shown a golf club according to the present invention which has a cylindrical shaft 22 connected to a club head 24 and a handle 26. The shaft 22 should be made from a highly flexible and easily torqued (e.g., twisted) material. Particularly good results have been achieved using a solid core, thermoset "E" type fiberglass (polyester blended with fiberglass) rod having a diameter of ¼ inch. Suitable thermoset "E" type fiberglass rods are available from Polygon, Inc. of Indiana. The advantage of this material is that the shaft 22 can be bent to a point where the head 24 is less than one foot the handle 26 without the shaft 22 breaking (see FIG. 6). While it is anticipated that a variety of other materials could be used for the shaft, it should be understood that more flexible and twistable materials are preferred, since a whippier shaft will require the golfer to swing the club with better tempo if the golf ball is to be struck correctly.

Figure 1:
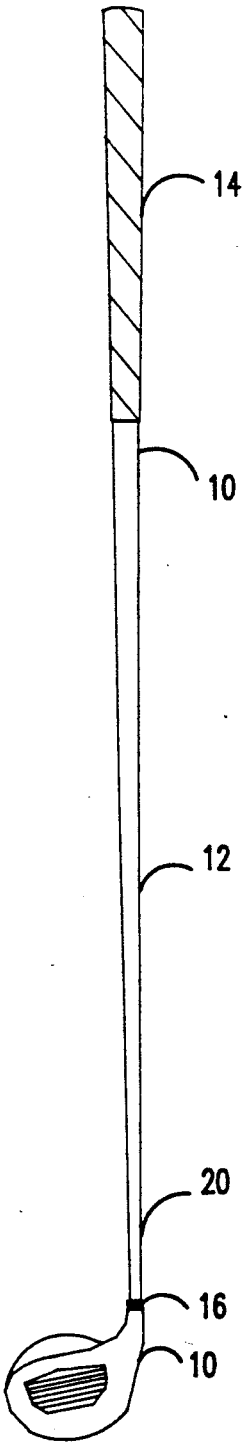
FIGURE 1 Prior art
FIG. 1 is an isometric side view of a conventional, prior art golf club.
Figure 3:
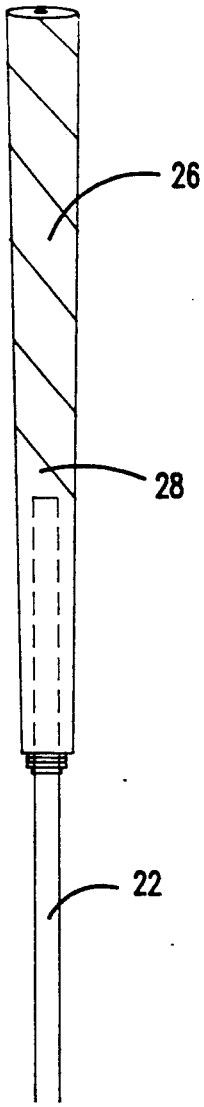
FIG. 3 is an enlarged side view of the handle and shaft of the golf club of FIG. 2 showing the shaft extends less than half way into the handle.

FIG. 3 shows that the shaft 22 terminates within a bore in the handle 26 at a point less than half the length of the handle. A preferred embodiment has the handle 26 being eleven and one half inches in length and the shaft 22 extending two and one half inches into the handle 26. The handle 26 is made of a flexible material such as hickory or plastic; however, hickory is preferred since it is lighter in weight and an objective of the club design is to allow the golfer to swing the club without becoming fatigued. Another objective accomplished with hickory is that the overall shaft weight is reduced so as to allow a greater weight in the clubhead while still keeping the overall weight lighter than conventional clubs. The handle 26 can be secured to shaft 22 by glue or other means and preferably has a leather or rubber grip secured to its outside surface which enables a golfer to firmly grasp the club, as is shown in FIGS. 1 and 5.

Having the handle 26 be flexible is an important part of this invention. It has been found that an eleven and one half inch hickory handle will have a flex point 28 (point of most severe bending during a hitting motion) approximately one half inch past the end of a shaft 22 which extends two and one half inches into the handle. This places the flex point 28 in the position where a golfer will place his or her thumb and index finger of the right hand in a normal grip position (see positioning of hands 30 in FIG. 5). If a golfer applies severe hand effort at the top of the backswing, the handle 26 will flex at flex point 28 and the flexing will be sensed by the golfer. Hence, the golfer will have some feedback from the club when he or she is using his or her hands incorrectly. Positioning of the flex point 28 can be changed by varying the degree the shaft 22 extends within the handle 26 and by the selection of the handle 26 materials. However, the flex point 28 should remain at a point on the handle 26 where a golfer's hands will be located during a golf swing; therefore, it is recommended that the end of the shaft 22 not extend more than half way into the handle 26 and that the handle 26 material be sufficiently flexible to allow a flexing sensation to be felt when the hands are used incorrectly.

With reference back to FIG. 2, because the handle 26 acts as an extension for the shaft 22 and because shaft 22 is cylindrical (e.g., not tapered towards the head 24), the shaft 22 has a flex point 32 which is closer to the handle 26 than the head 24. Having a high flex point 32 provides a long lever arm for the club head 24 which allows the position of the club head 24 to be felt at any point in the swing. The twistability of the shaft 22 causes the club head 24 face to open if an incorrect twisting motion or premature application of power with the right hand is used when striking a golf ball.

Figure 5:
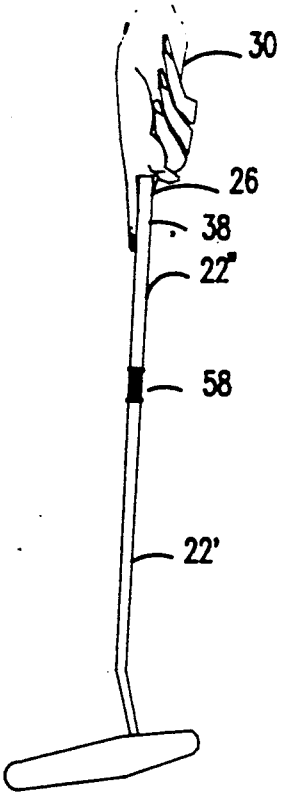
FIG. 5 is a side view of a putter showing sites where male-female connectors can be positioned in the shaft and showing the positioning of a golfers hands on the handle.
Figure 4:
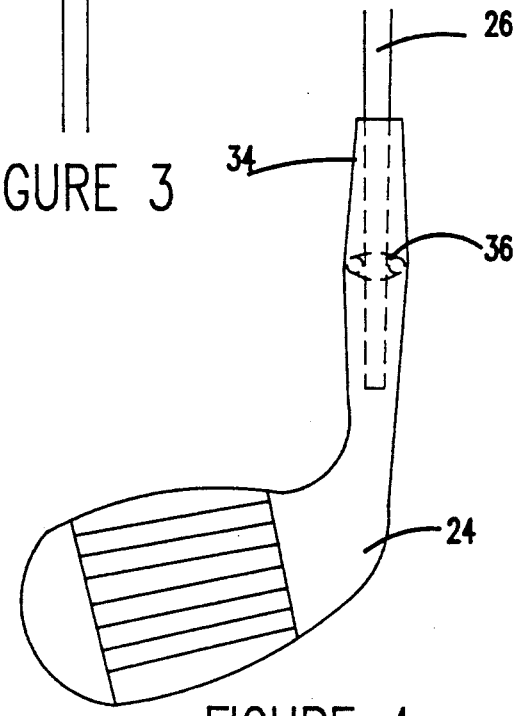
FIG. 4 is an enlarged, isometric side view of an iron showing a spring shock absorber located in the neck and encircling the shaft.

The club head 24 shown in FIG. 2 is a driver; however, an iron, as shown in FIG. 4, or a putter, as shown in FIG. 5, may also be employed. If a driver is used, favorable results have been found with a head 24 which weighs 213 gms (e.g., slightly heavier than a normal driver at 200 gms); however, the total weight of the club is twelve and three quarter ounces (e.g., a half an ounce lighter than a normal driver). By judicious selection of the materials, the head 24 weight can be maximized to increase the flexing action of the shaft 22 and handle 26, while still keeping the club at a total weight which will not fatigue a golfer using the club. The shaft 32 of a driver is preferably thirty two inches; however, the length can vary with the needs of the golfer. It should be noted that the length of the handle 26 extends the total length of the club to the customary forty three plus inches of a normal driver. The shaft 22 and handle 26 size will vary in length with shorter clubs.

It is anticipated that a particularly good method for teaching golfers to swing properly is to have the club head 24 disconnectable from the shaft 22 at point 25 so that heads of different weights could be attached to the shaft. A particularly good way to learn a good golf swing is to start with a club head which weighs 450 gms. This is a very heavy club head and will greatly emphasize the whippiness of the shaft 22. If the golfer is to strike the golf ball at all, he or she will be required to swing the golf club very slowly with the heavy club head. After the golfer can swing the club with the 450 gm weight properly, he or she can gradually progress to lighter weight club heads until a club head weight approved by the United States Golf Association is used (200 gm for drivers). Preferably, several club heads at 50 gm increments will be included in an instruction set (e.g., 450 gm, 400 gm, 350 gm, etc.).

FIG. 4 shows a preferred scheme for connecting a shaft 26 to a head 24 (iron or wood). With the shaft 26 being one quarter of an inch in diameter and the neck 34 of the average club head 24 being three eighths of an inch in diameter, there is some room between the shaft 22 and the neck 34. While the shaft 22 can be attached by epoxy, and larger shafts might also be chosen, it is preferable to position a shock absorbing spring 36 between the neck 34 and the shaft 26 prior to applying an epoxy. The spring 26 has its helical coils encircling the outside surface of the shaft 22 and provides a cushion that allows the shaft 22 to take a tremendous impact without breaking. This is very important with beginning golfers who swing the club hard in a hitting motion and have a tendency to strike the head 24 against the ground.

FIG. 5 shows that specialty clubs such as putters and sand wedges may have the flexible shaft formed from two or more members 22', and 22'' which are connected together by male-female connections 38 or the like. Preferably, the male-female connections will be glued to their respective shaft members and will occupy no more than an inch and a half in length on the shaft. Having the shaft break down to a more compact size will be analogous to a pool cue and will allow business men and women to conveniently carry the club in their briefcases. However, the use of a highly flexible shaft for training purposes will distinguish these clubs from their traditional counterparts.

While the invention has been described in terms of its preferred embodiments, those skilled in the art will recognize that the invention can be practiced with modification within the spirit and scope of the appended claims.

Having thus described my invention, what I claim as new and desire to secure by Letters Patent is as follows:

1. A training golf club, comprising:

a highly flexible shaft having a first and second end;

a head for striking a golf ball connected to said first end of said highly flexible shaft; and a flexible handle connected to said second end of said highly flexible shaft, said highly flexible shaft having a uniform diameter throughout its length, a capability of being bent to a point where the head is less than one foot from the handle without breaking, and providing said golf club with a first flex point located on said highly flexible shaft closer to said flexible handle than said head, said highly flexible shaft being constructed of a material that is easily twisted, said flexible handle providing said golf club with a second flex point located on said flexible handle, whereby flexing of said golf club at said first and second flex points and twisting of said highly flexible shaft each provide a golfer with sensory information.

2. A golf club as recited in claim 1 wherein said highly flexible shaft is made from fiberglass.

3. A golf club as recited in claim 2 wherein said highly flexible shaft has a solid core.

4. A golf club as recited in claim 1 wherein said head is a wood.

5. A golf club as recited in claim 1 wherein said head is an iron.

6. A golf club as recited in claim 1 wherein said head is a putter.

7. A golf club as recited in claim 1 further comprising a shock absorber positioned between said highly flexible shaft and said head in a hose for said head.

8. A golf club as recited in claim 7 wherein said shock absorber is a spring.

9. A golf club as recited in claim 1 wherein said highly flexible shaft extends into a bore in said flexible handle to a point less than half the length of said handle.

10. A golf club as recited in claim 1 wherein said flexible handle is made of wood.

11. A golf club as recited in claim 10 wherein said wood is hickory.

12. A golf club as recited in claim 10 further comprising a grip enhancing material on said handle.

13. A golf club as recited in claim 1 wherein said highly flexible shaft has two or more members which can be alternatively connected or disconnected.

14. A golf club as recited in claim 13 wherein said flexible handle has a means for easy disconnection from said highly flexible shaft.

15. A golf club as recited in claim 1 further comprising a plurality of additional heads, each of which is selectively connectable to said highly flexible shaft and each of which is different in weight.

16. A training golf club; comprising a highly flexible shaft having a first end and a second end;

a head for striking a golf ball connected to said first end of said highly flexible shaft; and a flexible handle connected to said second end of said highly flexible shaft, said second end of said highly flexible shaft extending into a bore in said flexible handle to a point less than half the length of said flexible handle, said highly flexible shaft having a uniform diameter throughout its length, a capability of being bent to a point where the head is less than one foot from the handle without breaking, and providing said golf club with a first flex point located on said highly flexible shaft closer to said flexible handle on said second end than to said head on said first end, said flexible handle providing said golf club with a second flex point located on said flexible handle past said point where said highly flexible shaft terminates inside said bore in said flexible handle, whereby flexing of said golf club at said first and second flex points provides a golfer with sensory input.

17. A golf club as recited in claim 16 wherein said highly flexible shaft is constructed of a material which is easily twisted, whereby twisting of said highly flexible shaft will open a clubface of said head and cause incorrect striking of a golf ball.

18. A golf club as recited in claim 17 wherein said material is fiberglass.

19. A golf club as recited in claim 17 wherein said highly flexible shaft has a solid core.

20. A method of learning a proper golf swing, comprising the steps of: providing (i) a golf club with a highly flexible shaft having a first and second end, (ii) a set of heads for striking a golf ball connected, each of said heads being selectively connectable to said first end of said highly flexible shaft, each of said heads in said set differing in weight; and (iii) a flexible handle connected to said second end of said highly flexible shaft, said highly flexible shaft having a uniform diameter throughout its length, a capability of being bent to a point where the head is less than one foot from the handle without breaking, and providing said golf club with a first flex point located on said highly flexible shaft closer to said flexible handle than said head, said highly flexible shaft being constructed of a material that is easily twisted, said flexible handle providing said golf club with a second flex point located on said flexible handle; and successively swinging the golf club with different heads of said set attached to said shaft wherein a heavier head is used first and the progression is to a lighter head.

* * * * *